US006534929B2

(12) United States Patent
Padilla

(10) Patent No.: US 6,534,929 B2
(45) Date of Patent: Mar. 18, 2003

(54) ELECTROMAGNETIC BALLAST FOR SEQUENTIALLY STARTING A PLURALITY OF A GASEOUS DISCHARGE LAMPS

(75) Inventor: Luis Alfonso Padilla, Crystal Lake, IL (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/912,459

(22) Filed: Jul. 25, 2001

(65) Prior Publication Data

US 2002/0067142 A1 Jun. 6, 2002

Related U.S. Application Data

(60) Provisional application No. 60/221,402, filed on Jul. 28, 2000.

(51) Int. Cl.[7] ..... H05B 41/16

(52) U.S. Cl. ..... 315/276; 315/177; 315/189; 315/257

(58) Field of Search ..... 315/177, 183, 315/189, 250, 254, 257, 276, 278, 99

(56) References Cited

U.S. PATENT DOCUMENTS

| | | | | | |
|---|---|---|---|---|---|
| 2,682,014 | A | | 6/1954 | Feinberg | 315/138 |
| 3,732,462 | A | * | 5/1973 | Neusbaum | 315/257 |
| 3,919,595 | A | * | 11/1975 | Willis, Jr. | 315/257 |
| 3,931,543 | A | * | 1/1976 | Nuckolls | 315/177 |
| 4,185,233 | A | * | 1/1980 | Riesland et al. | 315/276 |
| 4,740,731 | A | | 4/1988 | Crawford | 315/141 |
| 4,795,945 | A | * | 1/1989 | Mayer | 315/276 |
| 5,936,359 | A | * | 8/1999 | Gibson | 315/276 |

* cited by examiner

*Primary Examiner*—Hoang Nguyen

(57) ABSTRACT

An electromagnetic ballast for sequentially starting and simultaneously operating first and second gaseous discharge lamps includes a transformer having a magnetic core, a primary winding for connection to an AC voltage source and first and second secondary windings, all wound around the core. The first and second secondary windings are wound in opposite directions to produce voltages in opposition to each other. The ballast includes first and second series circuits, each including one of the lamps. The magnetic core has an elongated slot formed under the second secondary winding. The slot width relative to the core width, and to the slot length, are dimensioned to provide improved operating performance.

8 Claims, 1 Drawing Sheet

ELECTROMAGNETIC BALLAST FOR SEQUENTIALLY STARTING A PLURALITY OF A GASEOUS DISCHARGE LAMPS

RELATED APPLICATIONS

This application claims the benefit of U.S. Provisional Application No. 60/221,402, filed Jul. 28, 2000.

BACKGROUND OF THE INVENTION

1. Field of the Invention

This invention relates to electromagnetic ballasts for gaseous discharge lamps and particularly to such ballasts for sequentially starting and simultaneously operating a plurality of gaseous discharge lamps, such as fluorescent lamps.

2. Description of Related Art

U.S. Pat. No. 2,682,014, which is hereby incorporated by reference, describes several electromagnetic ballasts for starting and operating first and second gaseous discharge lamps.

Generally, each ballast includes a transformer having a primary winding P, a first secondary winding S1, and a second secondary winding S2. The windings are serially connected, with the secondary windings arranged in voltage bucking relationship. The first lamp is connected in series with a first capacitor across the series combination of the primary winding P and the first secondary winding S1. The second lamp is connected across the series combination of the first and second secondary windings. A second capacitor is also connected in series with the second lamp and the second secondary winding.

In operation, when the primary winding is energized by an AC supply voltage, both the primary winding P and the first secondary winding S1 will produce combined voltages which will be sufficient to ignite the first lamp. As a result, current will flow through the first secondary winding S1. Because of a high leakage reactance of winding S1, it will produce a voltage in phase with and additive to a voltage induced in the second secondary winding S2. These combined voltages will ignite the second lamp. With both of the lamps operating, there is a series path for the major portion of the current through the lamps, the first and second capacitors and the second secondary winding. The first secondary winding S1 is effectively bypassed because of its high leakage reactance, which impedes the flow of current through it. Such a first secondary winding is typically known in the art as a start winding or, alternatively, as a tickler winding. Because it carries so little current after both lamps have ignited, the tickler winding S1 typically comprises a large number of turns of very fine wire.

The function of the second capacitor is to protect the tickler winding against damage in the event that the second-to-start lamp L2 begins to function as a rectifying tube. This sometimes happens after long hours of operation of this lamp and results from the loss of emission material from one of the lamp electrodes. In that case, but for blocking action of capacitor C2, a pulsed DC current would flow through the lamp L2 and potentially damage or destroy the tickler winding.

Although the two-capacitor type of ballast described in U.S. Pat. No. 2,682,014 was effective in protecting the tickler winding from failure, it produced an unacceptable difference in the current and power delivered to the two lamps. It also produced starting currents which were too low to reliably ignite energy saver lamps.

U.S. Pat. No. 4,740,731, which is hereby incorporated by reference, describes a two-capacitor ballast having improvements for overcoming the above-mentioned problems. Schematically, the configurations of the ballast embodiments disclosed are similar or identical to those disclosed in U.S. Pat. No. 2,682,014. They also operate in generally the same way. However, in order to improve operating characteristics the capacitance of the second capacitor was limited to the range $C1 \leqq C2 \leqq 1.5(C1)$. Further, a slot in a portion of the transformer magnetic core structure around which the second secondary winding is wound had a transverse dimension (width) in the range of 25–50% of the width of the respective core portion. Preferably, the slot had a width approximately 35% of the core portion. A slot width of 65% was found to be unsatisfactory. Further, the ratio of the number of turns of the first secondary winding to the second secondary winding was approximately 1.53.

While the two-capacitor ballast described in U.S. Pat. No. 4,740,731 might have solved the current imbalance and starting reliability problems of the earlier ballast, it was not a commercial success. In particular, it produced unacceptably high vibration-noise levels and used too much power to comply with later-enacted Federal legislation setting minimum efficiency standards. It also passed an undesirably high AC current through the first secondary winding (tickler winding) when the second lamp was non-functional (i.e., inoperative or missing).

SUMMARY OF THE INVENTION

It is an object of the invention to provide an electromagnetic ballast of the above-described type which overcomes all of the above-mentioned problems.

It is another object of the invention to provide such a ballast which has a substantially-higher energy efficiency rating than comparable electromagnetic ballasts.

In order to achieve the above and other objects, a design study was undertaken which began with analyzing the operation of the basic single-capacitor ballast upon which U.S. Pat. No. 2,682,014 sought to improve. New design criteria were established which not only aimed at avoiding the above-mentioned problems, but also taking advantage of the lighting efficiencies of lamps currently on the market. In essence, the inventor reinvented the two-capacitor electromagnetic ballast. Although it schematically resembles ballast embodiments disclosed in U.S. Pat. Nos. 2,682,014 and 4,740,731, and operates in a similar manner, its design parameters are quite different.

In accordance with the invention, an electromagnetic ballast for sequentially starting and simultaneously operating first and second gaseous discharge lamps comprises a transformer including a magnetic core, a primary winding for connection to an AC voltage source and first and second secondary windings, all wound around the core. The first and second secondary windings are wound in opposite directions to produce voltages in opposition to each other. The ballast includes first and second series circuits. The first series circuit includes the primary winding, the first secondary winding, a first capacitor and the first lamp. The second series circuit is electrically connected in parallel with the first secondary winding and includes the second lamp, the second secondary winding and a second capacitor. The magnetic core has an elongated slot formed under the second secondary winding. The core and the slot have respective widths, substantially in a direction transverse to lines of flux produced in the core, such that a ratio of said slot width to said core width lies in the range of 60 to 70%. In a preferred form of the invention, the slot has a length in a direction substantially parallel to the lines of flux produced in the core, which slot width is much larger than the slot length.

DESCRIPTION OF THE PREFERRED EMBODIMENT(S)

Figure 1:
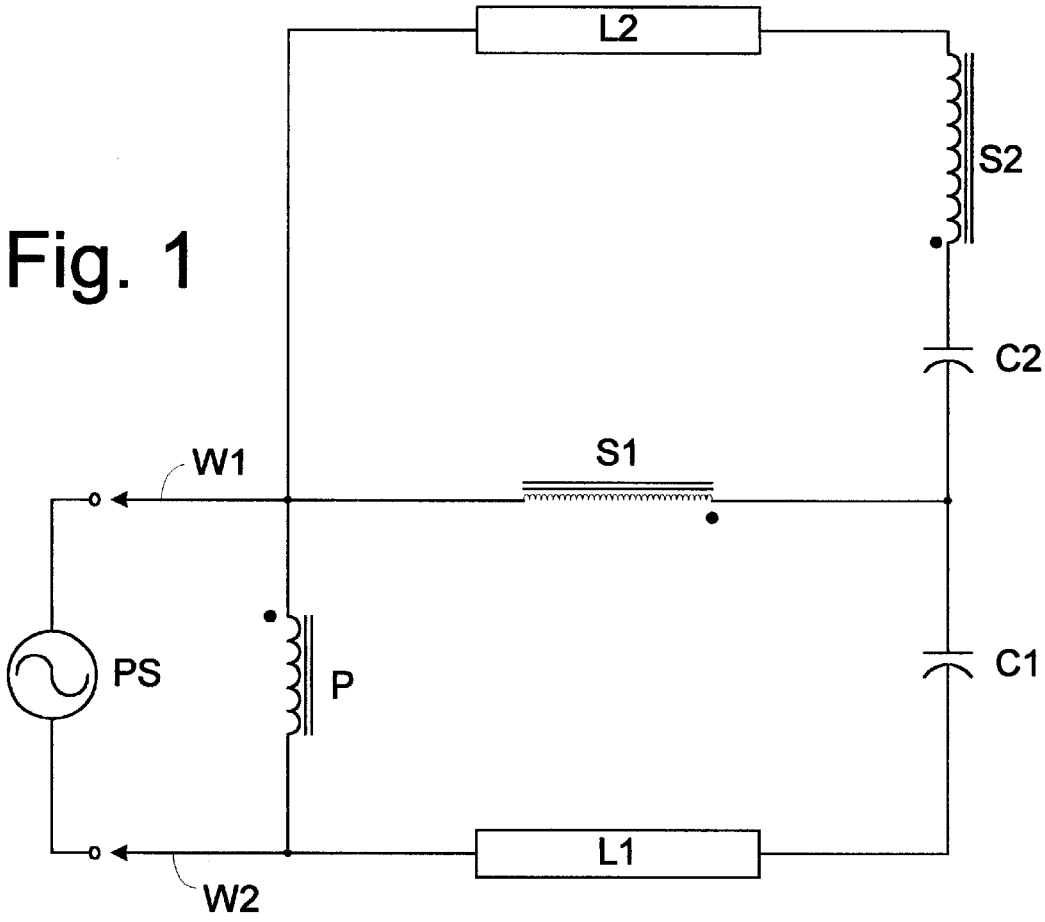
FIG. 1 is a schematic illustration of an embodiment of an electromagnetic ballast in accordance with the invention.
Figure 2:
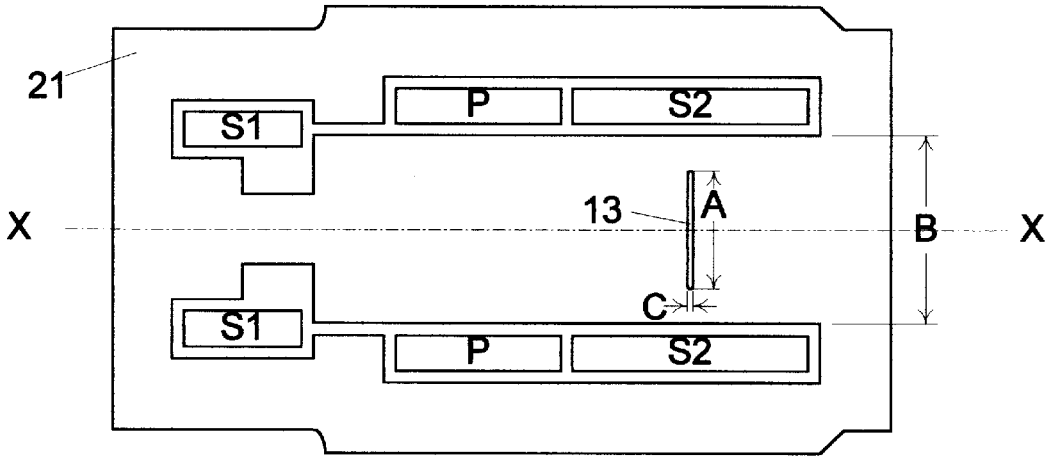
FIG. 2 is a sectional view of a transformer used in the embodiment of FIG. 1.

FIG. 1 schematically illustrates an exemplary embodiment of an electromagnetic ballast for sequentially starting and simultaneously operating serially connected first and second fluorescent lamps L1 and L2, respectively. The ballast includes a transformer having a primary winding P, a first secondary winding S1, and a second secondary winding S2. All of these windings are wound on a common core which is shown in FIG. 2. This core is substantially identical to that shown in FIG. 2 of U.S. Pat. No. 4,740,731, except for the changes described subsequently herein.

Briefly, the windings are disposed in windows of a laminated core 21 consisting essentially of a magnetic material, e.g. iron.

The windings are wound around a central portion of the core, which has a longitudinal axis X—X (the direction of the lines of flux in the core) and a width B transverse to the axis. The primary winding P is wound around the core between the secondary windings S1 and S2. The core includes a magnetic shunt disposed between the primary winding P and the secondary winding S1 (tickler winding) in the manner disclosed in U.S. Pat. Nos. 2,558,293 and 2,682,014, both of which are hereby incorporated by reference. The magnetic shunt causes tickler winding S1 to be loosely coupled with the primary winding P and to have a high leakage reactance. Secondary winding S2 is also loosely coupled to the primary winding, but is more closely coupled than is tickler winding S1. A slot 13, formed in the central portion of the core, has a width A transverse to the axis X—X and a length C parallel to the axis. Although the slot shown has a rectangular shape, other shapes which approximate a rectangle, e.g. an ellipse, may also be used.

The primary winding P and the tickler winding S1 are wound in the same direction to provide additive voltages. Conversely, secondary winding S2 is wound in the opposite direction to provide a subtractive voltage. Note that this is indicated in FIG. 1 by a dot symbol near one end of each winding.

As shown in FIG. 1, the primary winding P and the tickler winding S1 are electrically connected in series with a capacitor C1 and the first lamp L1. A series combination, including the second lamp L2, the second secondary winding S2 and a capacitor C2, is electrically connected in parallel with the tickler winding S1. First and second leads, W1 and W2 are electrically connected to respective opposite ends of the primary winding P for connecting the ballast to a source PS for providing AC power.

In operation, the ballast functions in manner which is generally similar to that described in U.S. Pat. No. 4,740,731. That is, when an AC voltage is applied via the leads W1 and W2 to the primary winding P, an additive voltage is induced in the tickler winding S1. The sum of these voltages appears across and ignites the first lamp L1. Simultaneously, the voltage induced in winding S2 opposes that induced in winding S1 and thus the difference between these voltages appears across the second lamp L2. This difference voltage is insufficient to ignite the second lamp.

After ignition, current flows through lamp L1, the capacitor C1 and the tickler winding S1. Because of the high leakage reactance of the winding S1 and the reactance of capacitor C1, a phase shift is produced such that the voltage that occurs in winding S1 as a result of the flow of current includes a component that is additive to the voltage induced in winding S2 by the primary winding P. The combined effect of the additive voltage component in winding S1 and the induced voltage in winding S2 ignites the second lamp L2.

With current flowing through both lamps, the relatively high inductive reactance of the tickler winding S1 opposes the flow of current through it. Thus, with both lamps ignited, current will flow in a series circuit including the lamps L1 and L2, the capacitors C1 and C2, and the secondary winding S2. Very little current will flow through the tickler winding and it can be made of a fine wire with a large number of turns. In the event that one of the cathodes of lamp L2 loses sufficient material for it to operate as a rectifier, series capacitor C2 will block the passage of a pulsating DC current that would otherwise flow through and potentially damage the tickler winding S1.

A marked improvement in performance of the ballast, over the ballast described in U.S. Pat. No. 4,740,731, was achieved by substantially increasing the ratio of the width A of the slot 13 to the width B of the central core portion and by substantially decreasing the flux density within the primary winding. Increasing the slot-width ratio had the effects of reducing the current through the tickler winding S1, when lamp L2 is not ignited and of improving the crest factor of the lamp current during normal operation. A slot-width to core-width ratio A:B of approximately 65±5% was found to be ideal, contrary to what was stated in U.S. Pat. No. 4,740,731. Less critical is the slot-width to slot-length ratio A:C, but the width A should be much larger than (i.e. at least 10×) the length C. A width-to-length ratio A:C of approximately 17:1 was used in a working model of the ballast that was constructed for starting and powering a plurality of different wattage instant-start fluorescent lamps (ranging from 50–75 Watts).

Decreasing the flux density had a synergistic effect on reducing vibration noise. It not only decreased the magnetic vibrational forces on the core lamination, but also reduced the losses in the core. This, in turn, enabled use of less expensive, thicker lamination plates which, by virtue of their greater thickness, are more resistant to vibrational forces. A flux density in the range of 10.5–12 kGauss worked well. Below about 10.5 kGauss the cost of copper and core material increases substantially. Above about 12 kGauss, performance of the ballast suffers because noise and magnetic field losses increase exponentially.

The preferable way to decrease flux density is to increase the number of turns in the primary winding. This has the beneficial consequence of increasing the impedance of the tickler winding S1, because the number of turns in the tickler winding must also be increased in order to maintain the same turns ratio of P:S1.

The maximum possible steady-state current through the tickler winding S1 occurs if lamp L1 ignites but lamp L2 fails to ignite or extinguishes. In this case, the magnitude of the current through the tickler winding is determined principally by the primary voltage $V_P$, the impedance $Z_{S1}$ of the tickler winding S1, the impedance $Z_{L1}$ of lamp L1, and the impedance $Z_{C1}$ of the capacitor C1. This results because of the low voltage across lamp L1 when it is ignited and the relatively low current through the tickler winding. As a good approximation, the current through the tickler winding S1, when only lamp L1 is ignited, is equal to $V_P/Z_1$, where $Z_1=Z_{S1}+Z_{C1}+Z_{L1}$. The value of the capacitor C1 is chosen, using the above approximation, to limit the tickler current to a maximum desired value.

During normal operation (i.e. both lamps ignited) very little current flows through the tickler winding S1 and the current through the lamps is determined principally by the primary voltage $V_P$, the voltage $V_{S2}$ induced in secondary winding S2, the impedance $Z_{S2}$ of the secondary winding S2, the impedance $Z_P$ of the primary winding P, the impedances $Z_{C1}$,$Z_{C2}$ of the capacitors C1,C2, and the impedances $Z_{L1}$,$Z_{L2}$ of the lamps L1,L2. As a good approximation, the current through each of the lamps is the same and is equal to $(V_P+V_{S2})/Z_{12}$, where $Z_{12}=Z_{S2}+Z_P+Z_{L1}+Z_{L2}$. The value of the capacitor C2 is chosen, using the above approximation, to establish the requisite current through the lamps for a desired level of light output. Preferably, to reduce energy consumption to a minimum, a value for capacitor C2 is chosen which effects a light output of less than 100% of maximum rated intensity for the specific lamps in use. A reduction of the light output to about 90–92% of full rated output is practically undetectable by the human eye.

A ballast of the type shown and described has been constructed and tested for starting and operating the following types of fluorescent lamps:

| TYPE | WATTAGE |
|---|---|
| F96T12 | 75 Watts |
| F96T12ES | 60 Watts |
| F84T12 | 70 Watts |
| F72T12 | 55 Watts |
| F64T12 | 52 Watts |
| F60T12 | 50 Watts |

This ballast had the following characteristics:

Slot dimensions (C×A): 0.850×0.050 in.

Slot-width to core-width ratio (A:B): 65%

Slot width-to-length ratio (A:C): 17

Capacitor C1: 2.5 μf, 460 V

Capacitor C2: 4.35 μf, 300 V

Turns ratio S1/S2: 1.56

Flux density (primary winding P): 11.5 kGauss

Average sound level: 33.5 dB

Input watts consumed (for 60 Watt lamp): 115 Watts

Lamp-current crest factor: 1.73

Tickler current $I_{S1}$, lamp L2 removed: 140 mA

What is claimed is:

1. An electromagnetic ballast for sequentially starting and simultaneously operating first and second gaseous discharge lamps, said ballast comprising:

a. a transformer including a magnetic core, a primary winding for connection to an AC voltage source and first and second secondary windings, all wound around said core, said first and second secondary winding being wound in opposite directions to produce voltages in opposition to each other;

b. a first series circuit including the primary winding, the first secondary winding, a first capacitor and the first lamp;

c. a second series circuit electrically connected in parallel with the first secondary winding and including the second lamp, the second secondary winding and a second capacitor;

said magnetic core having an elongated slot formed under the second secondary winding, said core and said slot having respective widths, substantially in a direction transverse to lines of flux produced in the core, such that a ratio of said slot width to said core width lies in the range of 60 to 70%.

2. An electromagnetic ballast as in claim 1 where the slot has a length in a direction substantially parallel to the lines of flux produced in the core, said slot width being much larger than said slot length.

3. An electromagnetic ballast as in claim 1 where the slot has a rectangular shape.

4. An electromagnetic ballast as in claim 1 where, in operation, the density of the flux lines produced in the core is in the range 10.5–12.0 kGauss.

5. An electromagnetic ballast as in claim 1 where the slot is positioned in the axial direction such that it is centrally located under the second sub winding.

6. An electromagnetic ballast as in claim 1 where the capacitance of the first capacitor is selected to limit the current through the first secondary winding in the event the second lamp is missing or unignited during operation.

7. An electromagnetic ballast as in claim 6 where the capacitance of the second capacitor is selected to, in serial combination with the capacitance of the first capacitor, limit the current through the first and second lamps during operation.

8. An electromagnetic ballast as in claim 7 where the capacitance of the second capacitor is selected to limit said current to approximately 90% of maximum rated light output of the lamps.

* * * * *